US005806279A

United States Patent [19]

Spatafora

[11] Patent Number: 5,806,279

[45] Date of Patent: Sep. 15, 1998

[54] METHOD AND UNIT FOR PACKING PRODUCTS

[75] Inventor: Mario Spatafora, Bologna, Italy

[73] Assignee: Azionaria Costruzioni Macchine Automatiche A.C.M.A. S.p.A., Bologna, Italy

[21] Appl. No.: 699,818

[22] Filed: Aug. 19, 1996

[30] Foreign Application Priority Data

Aug. 24, 1995 [IT] Italy ..... B095A 0405

[51] Int. Cl.[6] ..... B65B 27/00; B65B 11/58

[52] U.S. Cl. ..... 53/399; 53/449; 53/176; 53/482; 53/586; 53/582; 53/375.5

[58] Field of Search ..... 53/399, 449, 176, 53/586, 590, 582, 482, 374.7, 375.5

[56] References Cited

U.S. PATENT DOCUMENTS

| | | | |
|---|---|---|---|
| 1,400,202 | 12/1921 | Armstrong . | |
| 2,077,431 | 4/1937 | Neumair | 53/586 X |
| 2,194,451 | 3/1940 | Soubier | 53/449 X |
| 3,479,792 | 11/1969 | Jensen et al. | 53/586 X |
| 4,559,757 | 12/1985 | Focke et al. | 53/176 |
| 5,452,561 | 9/1995 | Thompson et al. | 53/590 X |

FOREIGN PATENT DOCUMENTS 2310262 12/1976 France .

*Primary Examiner*—Linda Johnson
*Attorney, Agent, or Firm*—Oblon, Spivak, McClelland, Maier & Neustadt, P.C.

[57] ABSTRACT

A method and unit for packing products in sealed packages, whereby a sealed pillow pack wrapping formed about a respective product is fed along a path extending through a wrapping station where a band is looped about a central body of the sealed wrapping and about two end tabs of the sealed wrapping to form a tubular overwrapping; the two end tabs having been folded beforehand on to a large lateral surface of the central body.

11 Claims, 2 Drawing Sheets a)
b)
c)

METHOD AND UNIT FOR PACKING PRODUCTS

BACKGROUND OF THE INVENTION

The present invention relates to a method of packing products.

The present invention relates to a particularly straightforward, low-cost method of packing products, particularly food products, in sealed packages presenting graphics indicating the type and characteristics of the packaged product.

According to the present invention, there is provided a method of packing products in sealed packages, the method comprising the step of forming, about each product, a sealed pillow pack wrapping presenting a longitudinal axis; and the method being characterized by comprising a further step of overwrapping the sealed wrapping; said further step comprising the substeps of feeding the sealed wrapping along a path extending through a wrapping station; supplying said wrapping station simultaneously with a band and said sealed wrapping; and looping said band about said sealed wrapping to form, about the sealed wrapping, a tubular overwrapping.

Since the graphics normally required for identifying the products inside the sealed packages produced using the above method may be formed on the bands, the method according to the present invention not only eliminates the need for forming the sealed wrappings from continuous strips presenting graphics for each packaged product and involving rigidly coordinated supply—relatively difficult and expensive to achieve of the continuous strip and products to the wrapping station, but also eliminates the need for using a specific strip for each type of product to be wrapped.

According to a preferred embodiment of the above method, said sealed wrapping comprises a central body, and two end tabs extending from respective longitudinal ends of the central body; the above method also comprising the step of folding said tabs crosswise to said longitudinal axis and on to a large lateral surface of the central body; and said tabs being folded along said path and upstream from the wrapping station.

Preferably, said step of looping said band about said sealed wrapping comprises the further steps of securing a central portion of the band on to a small lateral surface of said central body; partially folding said band about said central body to form an open, substantially U-shaped wrapping presenting two end portions of said band projecting in relation to said large lateral surface; gumming an inner surface of at least one of said two end portions of said band; and folding said two end portions squarely one on top of the other so that the gummed end portion adheres to the other end portion.

The present invention also relates to a unit for packing products.

SUMMARY OF THE INVENTION

According to the present invention, there is provided a unit for packing products in sealed packages, the unit comprising a wrapping machine for forming, about each product, a sealed pillow pack wrapping presenting a longitudinal axis and comprising a substantially parallelepiped central body and two end tabs extending from opposite longitudinal ends of the central body; the unit being characterized by also comprising conveying means for feeding the sealed wrapping along a path extending through a wrapping station; supply means for supplying said wrapping station simultaneously with a band and said sealed wrapping; and first folding means for looping said band about said sealed wrapping to form, about the sealed wrapping, a tubular overwrapping.

According to a preferred embodiment of the present invention, the above unit also comprises second folding means for folding said tabs crosswise to said longitudinal axis and on to a large lateral surface of the central body; said second folding means being located along said path and upstream from the wrapping station.

Preferably, said first folding means comprise retaining means for securing a central portion of said band on to a small lateral surface of said central body; a first folding element cooperating with said band and said central body to partially fold said band about the central body and form an open, substantially U-shaped wrapping presenting two end portions of said band projecting in relation to said large lateral surface; and second folding elements for folding said two end portions squarely one on top of the other; one of said end portions being an outer portion outside the other; and gumming means being provided for gumming an inner surface of said outer portion.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 3:
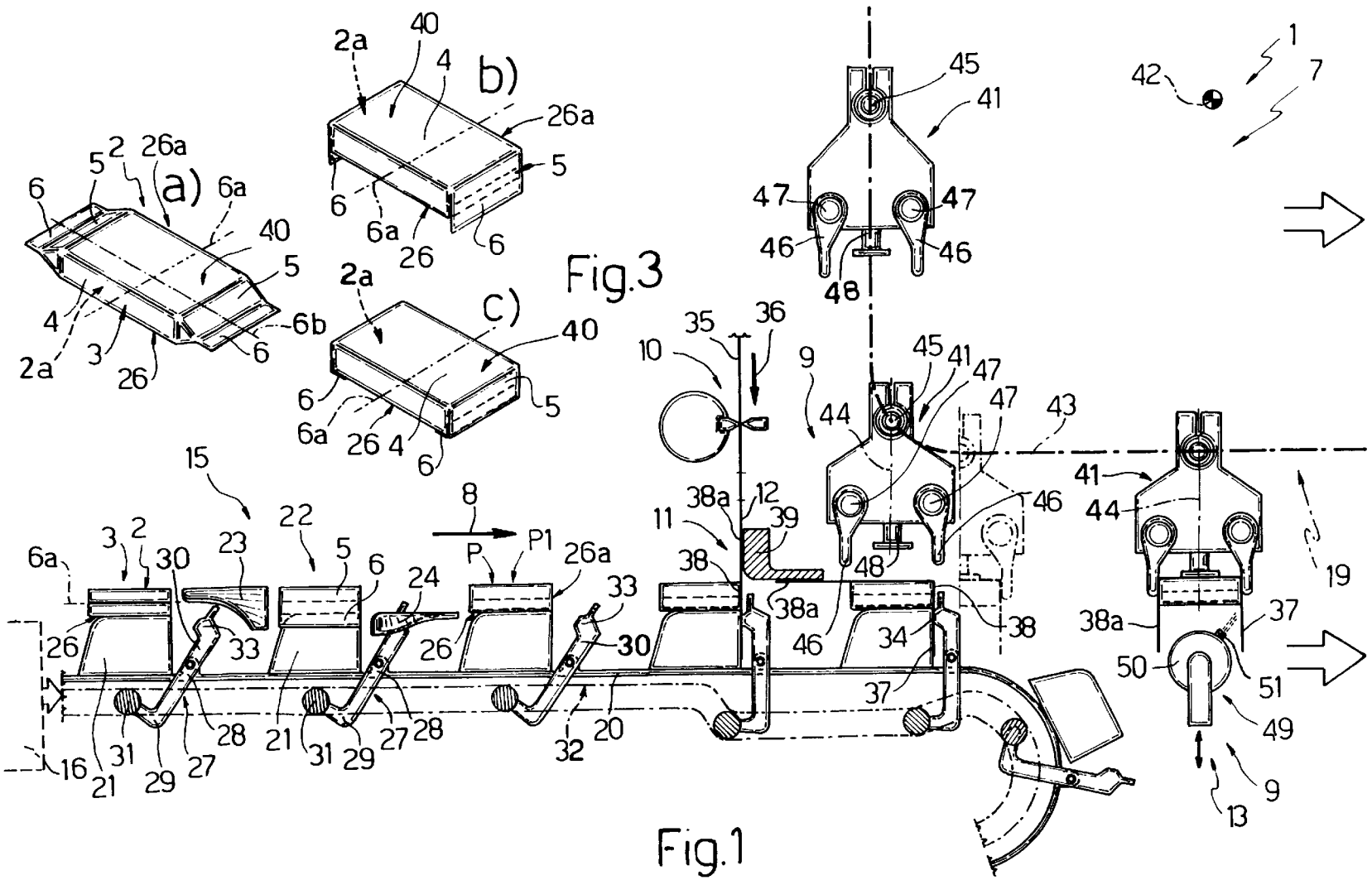
FIG. 1 shows a schematic side view, with parts in section and parts removed for clarity, of an input portion of a packing unit in accordance with the teachings of the present invention.
FIGS. 3 and 4 show, in perspective, a succession of operating steps performed by the FIG. 1 and 2 unit.
Figure 2:
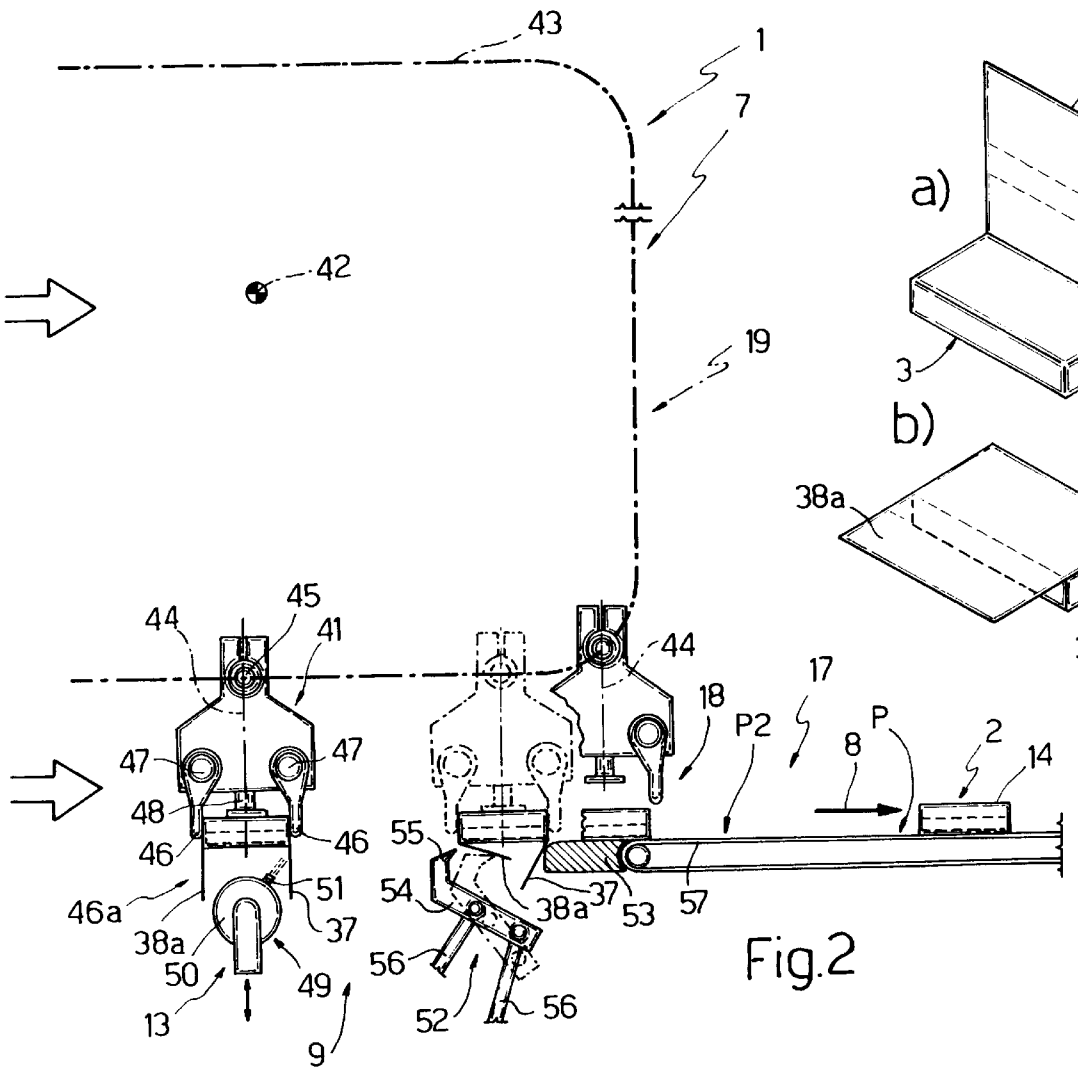
FIG. 2 shows a schematic side view, with parts in section and parts removed for clarity, of an output portion of the FIG. 1 unit.

With reference to FIGS. 1 to 3, number 1 indicates a unit for packing food products 2*a* in packages 2 comprising a sealed wrapping 3 presenting a longitudinal axis 6*b* and defined by a substantially parallelepiped central body 4 and by two end portions 5 extending from opposite ends of central body 4 and each presenting a respective longitudinal tab 6 parallel to an axis 6*a* crosswise to axis 6*b* of sealed wrapping 3.

Unit 1 comprises a conveyor assembly 7 for feeding a succession of wrappings 3 in a direction 8 parallel to axis 6*a*, and along a path P extending through a wrapping station 9; and a known cutting and supply device 10 located at the input 11 of station 9, and for feeding in front of input 11, for each wrapping 3, a substantially rectangular band 12 (FIG. 4*a*) of a width substantially equal to the length of central body 4.

Unit 1 also comprises a wrapping assembly 13 located at station 9, and for looping each band 12—as described in more detail later on—about respective wrapping 3 to form a tubular overwrapping 14 (FIG. 4*e*) enclosing at least central body 4 of wrapping 3 and completing respective package 2.

Conveyor assembly 7 comprises an input conveyor 15 defining an input portion P1 of path P extending towards input 11 of station 9 from a "form, fill and seal" wrapping machine 16 forming part of unit 1 and for forming wrappings 3 in known manner (not shown). As shown in FIG. 2, assembly 7 also comprises an output conveyor 17 defining an output portion P2 of path P extending outwards of unit 1 from the output 18 of station 9. Finally, assembly 7 comprises a transfer device 19 located between conveyors 15 and 17, along path P, for receiving wrappings 3 together with respective bands 12 from conveyor 15, feeding wrappings 3 and bands 12 through station 9, and feeding wrappings 3 with respective overwrappings 14 to conveyor 17.

Conveyor 15 comprises a conveyor belt 20 looped about two pulleys (not shown) and traveling along path portion P1; and a number of known suction supports 21 integral with belt 20. By means of each support 21, conveyor 15 retains each wrapping 3 so that end portions 5 of wrapping 3 project laterally from support 21, and feeds wrappings 3 along path portion P1 and through a folding station 22 located upstream from station 9. Station 22 comprises known shaped folding plates 23 and 24 forming part of unit 1 and located in fixed positions and in series along path portion P1. More specifically, plates 23 and 24 are arranged in pairs on either side of path portion P1; plates 23 cooperate with end portions 5 of each wrapping 3 to fold portions 5 (FIG. 3*b*) by rotating them parallel to axis 6*a* so that respective tabs 6 project in relation to a large lateral surface 26 of central body 4; and plates 24 cooperate with tabs 6 to fold them squarely on to lateral surface 26.

For each support 21, conveyor 15 comprises a rocker arm 27 in turn comprising a central portion 28 pivoting on belt 20 in front of respective support 21, and two arms 29 and 30 extending on either side of portion 28. Arm 29 is substantially L-shaped, and is fitted on its free end with a tappet roller 31 engaging in rolling manner a cam 32 extending beneath and along belt 20; and arm 30 is fitted on its free end with a pad 33, which is swung by cam 32 between an engaged position, wherein pad 33 engages a front surface of respective support 21 and, together with support 21, grips a portion 34 (FIG. 4*a*) close to an end portion 37 of respective band 12 supplied by device 10, and a release position wherein pad 33 is positioned a given distance from said front surface of support 21.

Device 10 provides for successively cutting bands 12 from a strip 35 of wrapping material bearing on one surface a number of graphics (not shown), and feeds each band 12 in a direction 36 crosswise to direction 8, so that band 12 is positioned across portion P1 of path P and between a respective support 21 and a respective pad 33 in the release position. When portion 34 of band 12 is gripped, in use, by pad 33, band 12 is positioned with end portion 37 beneath pad 33 and contacting said front surface of respective support 21, with a central portion 38 contacting a small lateral wall 26*a* of wrapping 3, and with a further end portion 38*a* projecting vertically above wrapping 3.

Wrapping assembly 13 comprises a folding plate 39 located over path P at input 11 of station 9, and for folding each band 12 in an L about respective central body 4, so that portion 38*a* is coplanar with a further large lateral surface 40 (FIG. 3) of wrapping 3; and a number of folding elements or means or gripping heads 41, which are rotated by transfer device 19 about an axis of rotation 42 of device 19 and along an endless path 43 extending partly through station 9 and parallel to path P, to transfer wrappings 3 from conveyor 15 to conveyor 17 while at the same time partly folding respective bands 12.

More specifically, heads 41 each present an axis of symmetry 44, are fitted to respective pins 45 equally spaced about axis 42, and are rotated about axis 42 and along path 43 by a known epicyclic transmission (not shown) so that respective axes 44 are maintained parallel to themselves and perpendicular to direction 8. Each head 41 comprises two jaws 46 located on either side of axis 44, and for gripping each wrapping 3 on respective support 21 to further fold band 12 so that portion 38*a* faces portion 37 on the opposite side of central body 4, and so form an open, substantially U-shaped wrapping 46*a*.

Each head 41 also comprises a pair of pins 47 for elastically supporting jaws 46 and permitting jaws 46 to adapt slightly in relation to head 41 when gripping wrapping 3; and a piston 48 fitted to head 41, between jaws 46, and movable along axis 44, and in relation to head 41, between a withdrawn position in which it cooperates with jaws 46 to maintain wrapping 3 in a fixed position, and an extracted position (not shown) in which it expels wrapping 3 on to conveyor 17 downstream from output 18 of station 9.

Assembly 13 also comprises a gumming device 49 located beneath path P, between input 11 and output 18, and which is moved crosswise to direction 8 by a known actuating device (not shown), and inserted between portions 37 and 38*a* beneath wrapping 3 to gum the side of portion 37 facing portion 38*a*. Gumming device 49 comprises a rotary disk 50; and at least one sprayer 51 fitted to disk 50 so as to rotate about an axis parallel to axis 42 and to gum said side of portion 37 as wrapping 3 travels through station 9.

Figure 4:
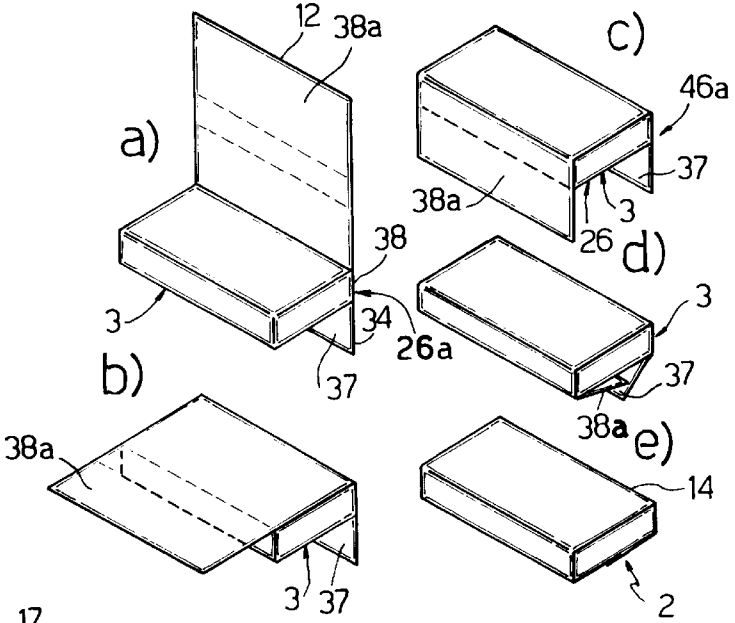

Assembly 13 also comprises a movable folding element 52 and a further folding plate 53, both located at output 18 and for respectively folding portion 38*a* squarely on to surface 26, and portion 37 squarely on to portion 38*a* (FIGS. 4*d* and 4*e*). Movable folding element 52 is defined by an articulated quadrilateral comprising a connecting rod 54, a substantially L-shaped end 55 of which cooperates with and squarely folds portions 38*a*; and two rocker arms 56 supporting connecting rod 54 and activated in known manner (not shown) to move portion 38*a* parallel to direction 8 and at a speed greater than a given traveling speed of heads 41. Folding plate 53 is located at output 18, is connected at the top to the transportation branch 57 of conveyor 17, and cooperates with portions 37 to fold them squarely and press them on to respective portions 38*a* (FIGS. 4*d* and 4*e*) to form tubular overwrapping 14.

Operation of unit 1 will now be described with reference to one wrapping 3 produced by wrapping machine 16 and fed by conveyor assembly 7 along path P.

Wrapping 3 is deposited on to respective support 21, and is fed by conveyor 15 along path portion P1 and between plates 23 and 24, which, as stated, fold tabs 6 on to surface 26. As wrapping 3 reaches input 11, device 10 supplies a band 12, which is gripped between said front surface of support 21 and pad 33; and, as wrapping 3 moves beneath plate 39, band 12, still gripped by pad 33, is folded into an L.

At this point, device 19 feeds a gripping head 41 along path 43 and along a trajectory comprising a vertical component crosswise to direction 8, and a horizontal component parallel to direction 8. The horizontal component of the trajectory of head 41 enables head 41 to be aligned with and follow wrapping 3 along a portion of path P, while the vertical component enables jaws 46 to grip wrapping 3 on either side of central body 4, and fold portion 38*a* of band 12 squarely to form an open, substantially U-shaped wrapping 46*a*.

Once head 41 has gripped wrapping 3 and formed wrapping 46*a*, support 21 releases wrapping 3, which is then fed by head 41 through station 9 and over gumming device 49, the sprayer 51 of which is inserted by disk 50 between portions 37 and 38*a*, is rotated to gum said inner side of portion 37, and is then set to an operating position wherein neither sprayer 51 nor disk 50 can interfere with portions 37 and 38*a*.

At this point, head 41 feeds wrapping 3 over element 52, the end 55 of which folds portion 38*a* squarely, and then over and in contact with plate 53, which folds portion 37 squarely and presses it on to portion 38*a* to form tubular overwrapping 14 and, therefore, package 2.

Package 2 is then released by head 41 on to branch 57 of conveyor 17, which feeds package 2 itself along path P2.

I claim:

1. A method of packing products in sealed packages, the method comprising the steps of:

forming, about each product, a sealed pillow pack wrapping having a longitudinal axis and comprising a central body, substantially shaped as a parallelepiped, and two sealed end tabs extending from respective longitudinal ends of the central body;

L-folding said sealed tabs crosswise to said longitudinal axis to bring an end part of said sealed tabs into contact with a large lateral surface of the central body for shaping said sealed wrapping to a parallelepiped substantially coinciding with said central body;

overwrapping the sealed wrapping by feeding the sealed wrapping along a path extending through a wrapping station;

supplying said wrapping station simultaneously with said sealed wrapping, and with a band substantially rectangular in shape and having a width substantially equal to the length of said central body; and looping said band about said sealed wrapping to form, about the sealed wrapping, a tubular overwrapping enclosing said central body and said end parts of said folded sealed tabs, said tabs being folded along said path and upstream from the wrapping station.

2. A method as claimed in claim 1, wherein said tubular overwrapping is coaxial with said longitudinal axis.

3. A method as claimed in claim 1, wherein said step of looping said band about said sealed wrapping comprises the further steps of:

feeding said band in a direction crosswise to said path;

engaging a central portion of said band with a small lateral surface of said central body by advancing said sealed wrapping along said path, and at the same time folding into a L-shape said band about said central body;

engaging said band and said sealed wrapping by means of gripping means for partially folding said band about said central body to form an open, substantially U-shaped wrapping having two end portions of said band projecting in relation to said large lateral surface;

gumming an inner surface of one of said two end portions of said band; and folding said two end portions of said band squarely one on top of the other so that the gummed end portion adheres to the other end portion.

4. A unit for packing products in sealed packages, the unit comprising:

a wrapping machine for forming, about each product, a sealed pillow pack wrapping having a longitudinal axis and comprising a substantially parallelepiped central body and two sealed end tabs extending from opposite longitudinal ends of the central body;

first folding means for L-folding said tabs crosswise to said longitudinal axis to bring an end part of said sealed tabs into contact with a large lateral surface of the central body for shaping said sealed wrapping to a parallelepiped substantially coinciding with said central body;

conveying means for feeding the sealed wrapping along a path extending through a wrapping station;

supply means for supplying said wrapping station simultaneously with said sealed wrapping and a substantially rectangular band of a width substantially equal to the length of said central body; and second folding means for looping said band about said sealed wrapping to form, about the sealed wrapping, a tubular overwrapping enclosing said central body and said end parts of said folded sealed tabs, wherein said first folding means are located along said path and upstream from the wrapping station.

5. A unit as claimed in claim 4, wherein said second folding means are designed to loop said band so that said tubular overwrapping is coaxial with said longitudinal axis.

6. A unit as claimed in claim 5, wherein said first folding means are located in a fixed position along said path.

7. A unit as claimed in claim 4, wherein said second folding means comprise:

supplying means for feeding said band in a direction crosswise to said path;

third folding means for folding into an L-shape said band about said central body when a central portion of said band is engaged by a small lateral surface of said central body;

a first folding element comprising gripping means cooperating with said band and said central body to partially fold said band about the central body and form an open, substantially U-shaped wrapping having two end portions of said band projecting in relation to said large lateral surface;

second folding elements for folding said two end portions squarely one on top of the other, one of said end portions being an outer portion outside the other;

and gumming means being provided for gumming an inner surface of said outer portion.

8. A unit as claimed in claim 7, wherein said third folding means comprise retaining means for securing a central portion of said band onto a small lateral surface of said central body, said retaining means being movable together with said conveying means along said path.

9. A unit as claimed in claim 8, wherein said conveying means comprise:

an input conveyor for successively feeding said sealed wrappings to an input of said wrapping station;

an output conveyor in series with the input conveyor along said path, and for receiving said sealed wrappings together with respective tubular overwrappings; and a transfer assembly located at said wrapping station, between said input and output conveyors, and for receiving said sealed wrappings together with respective bands from said input conveyor, feeding the sealed wrappings together with the respective bands through the wrapping station, and feeding the sealed wrappings together with the respective tubular overwrappings to said output conveyor.

10. A unit as claimed in claim 9, wherein said transfer assembly comprises a respective said first folding element, wherein each said first folding element further comprises a gripping head for gripping a respective sealed wrapping at the input of said wrapping station.

11. A unit as claimed in claim 10, wherein said gripping head comprises two jaws for gripping a respective sealed wrapping together with said band folded into an L-shape, to form said open, substantially U-shaped wrapping.

* * * * *